US005389733A

United States Patent [19]

Enoki et al.

[11] Patent Number: 5,389,733

[45] Date of Patent: Feb. 14, 1995

[54] DEVELOPING DEVICE FOR AN IMAGE FORMING APPARATUS

[75] Inventors: Shigekazu Enoki; Yoshiaki Tanaka, both of Kawasaki; Takeshi Motohashi, Yokohama; Fumihiro Kitahara, Tokyo; Koyo Hariyama, Minoo, all of Japan

[73] Assignee: Ricoh Company, Ltd., Tokyo, Japan

[21] Appl. No.: 202,548

[22] Filed: Feb. 28, 1994

[30] Foreign Application Priority Data

Feb. 26, 1993 [JP] Japan ..... 5-062805

[51] Int. Cl.[6] ..... G03G 15/09

[52] U.S. Cl. ..... 118/657; 355/251; 355/253

[58] Field of Search ..... 118/657, 653, 654; 355/251, 253, 245

[56] References Cited

U.S. PATENT DOCUMENTS 3,962,992 6/1976 Takagi et al. .

4,266,503 5/1981 Uehara .

*Primary Examiner*—R. L. Moses

*Attorney, Agent, or Firm*—Oblon, Spivak, McClelland, Maier & Neustadt

[57] ABSTRACT

A developing device which is particularly advantageous from the standpoint of avoiding leakage or scattering of toner. The developing device is additionally advantageous in allowing for a compact design while reliably supplying toner to the complete area of a photosensitive member upon which a latent image is formed. The developing device includes a toner container having an opening in a lower part thereof, through which toner falls. A magnet bar is provided below the opening, with a developing grid covering a portion of the magnet bar. The magnet bar forms a magnetic toner brush which penetrates through holes in the developing grid, with the magnetic toner brush and grid cooperating to prevent excessive toner from falling through the opening and thus preventing excessive toner from scattering outside the developing device.

10 Claims, 7 Drawing Sheets

DEVELOPING DEVICE FOR AN IMAGE FORMING APPARATUS

BACKGROUND OF THE INVENTION

1. Field of the Invention

The invention relates to an improved developing device for an image forming apparatus, such as a copier, facsimile machine, printer, etc.

2. Discussion of Background

A conventional developing device for an image forming apparatus utilizes a dry-type toner to form or develop an image, with the image forming apparatus including a developing sleeve for carrying toner thereon, and with the sleeve disposed adjacent to a photosensitive drum. A magnet roller is disposed inside of the sleeve member, and parallel to the axis of the sleeve member. The magnet produces a magnetic force such that toner on the sleeve forms a magnetic brush which develops a latent image formed on the photosensitive drum.

With such a device, a bearing for the sleeve is disposed outside of the magnet roller (i.e. in the axial direction of the magnet roller), with an edge of the sleeve member outside of the bearing. In addition, a supporting part for the axle or axis of the magnet roller is disposed outside of the edge of the sleeve member (an example of such an arrangement is shown in Japanese Patent Publication No. 41-3428/1966, or Japanese Patent Publication No. 62-57991/1987). As a result, the width of such a developing device is necessarily larger than that of the latent image area which is developed by the developing device. Accordingly, it is difficult to minimize the size of the developing device, although the size of many other parts of the image forming device have recently been reduced.

Another concern with developing devices resides in the avoidance of deterioration of toner accommodated in the toner container, which deterioration can be caused by the conveying mechanism installed in the toner supplying container. An arrangement which attempts to avoid this problem includes a toner container which accommodates the toner, with an outlet at a lower part of the toner container, and a magnetic member disposed adjacent the outlet such that toner falls by gravity through the outlet, without requiring a toner conveying member. An example of this type of arrangement is shown in Japanese Patent Publication No. 58-52587/1983. However, with such a device, toner scattering occurs as a result of vibrations which occur in the machine during developing, and the scattering toner can cause contamination of the surrounding parts or components of the device.

SUMMARY OF THE INVENTION

The present invention addresses the above problems associated with conventional developing devices.

Accordingly, it is an object of the present invention to provide a developing device for an image forming apparatus which can reliably present toner to a photosensitive member for developing a latent image formed on the photosensitive member.

It is another object of the present invention to provide a developing device which can reliably feed toner for developing a latent image, with deterioration of the toner minimized, while also minimizing scattering of toner during developing.

These and other objects and advantages are achieved in accordance with the present invention which includes a structure which avoids leakage of toner from the developing device. This structure includes a supply container having an opening at a lower part thereof through which the toner falls by gravity. In addition, a magnet bar is provided, which forms a magnetic toner brush, with the brush disposed adjacent to the opening. In addition, a developing grid is disposed to surround the magnet bar, with the upper edge of the grid fixed to a part below the opening through which the toner falls. The magnet bar thus forms the magnetic toner brush with penetrating holes provided in the developing grid, such that part of the magnetic toner brush blocks the toner from falling through the opening of the toner supply container (as a result of the toner which has been previously fed to form the magnetic brush). In accordance with the arrangement of the present invention, the magnetic toner brush and the developing grid structure share in the prevention of excess falling toner or scattering of toner, or in other words, the brush and grid oppose the pressure of additional toner falling from the toner supply container.

BRIEF DESCRIPTION OF THE DRAWINGS

A more complete appreciation of the invention and many of the attendant advantages thereof will be readily understood with reference to the following detailed description, particularly when considered in conjunction with the accompanying drawings, wherein:

FIG. 1(*b*) is a perspective view of the printer with the cover open;

DESCRIPTION OF THE PREFERRED EMBODIMENTS

Figure 1A:
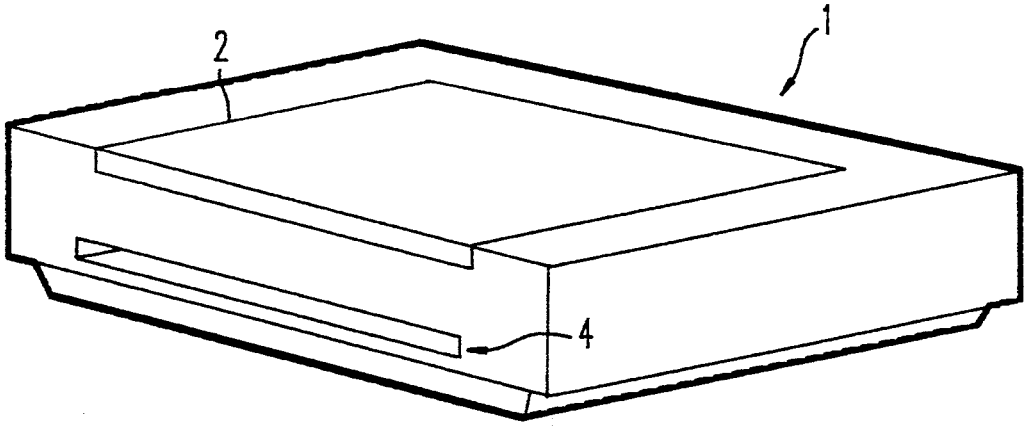
FIG. 1(*a*) is a perspective view of an example of a printer including a developing device in accordance with the present invention, with the cover in the closed position.
Figure 1B:
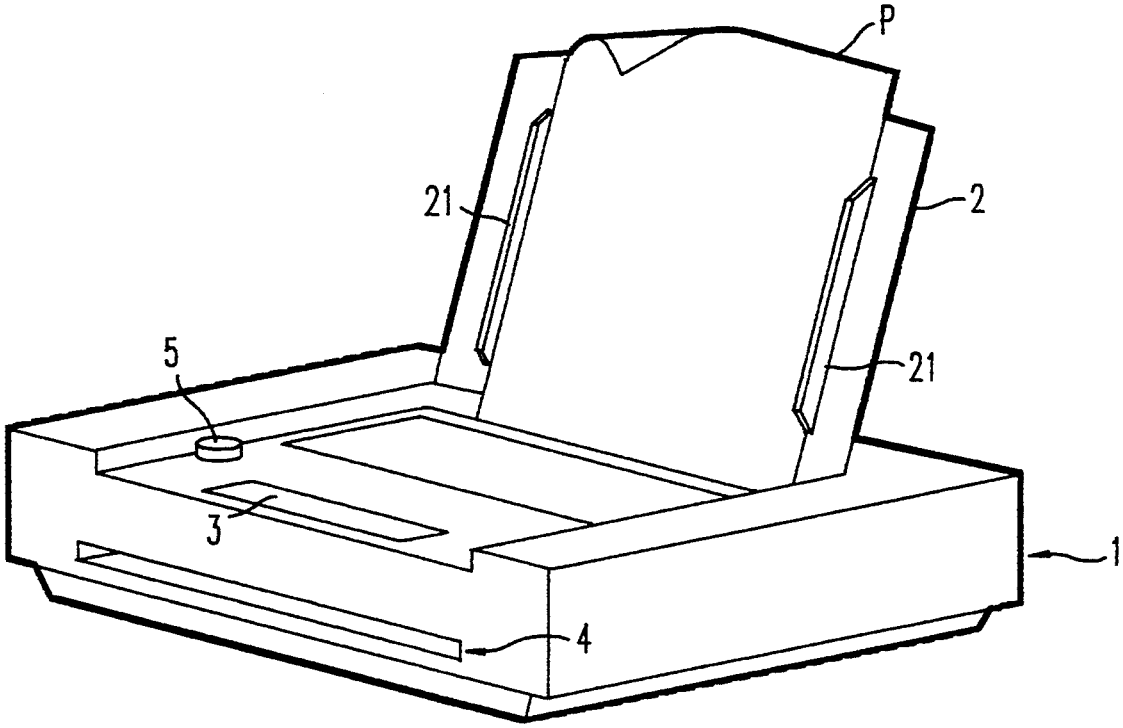
Figure 2:
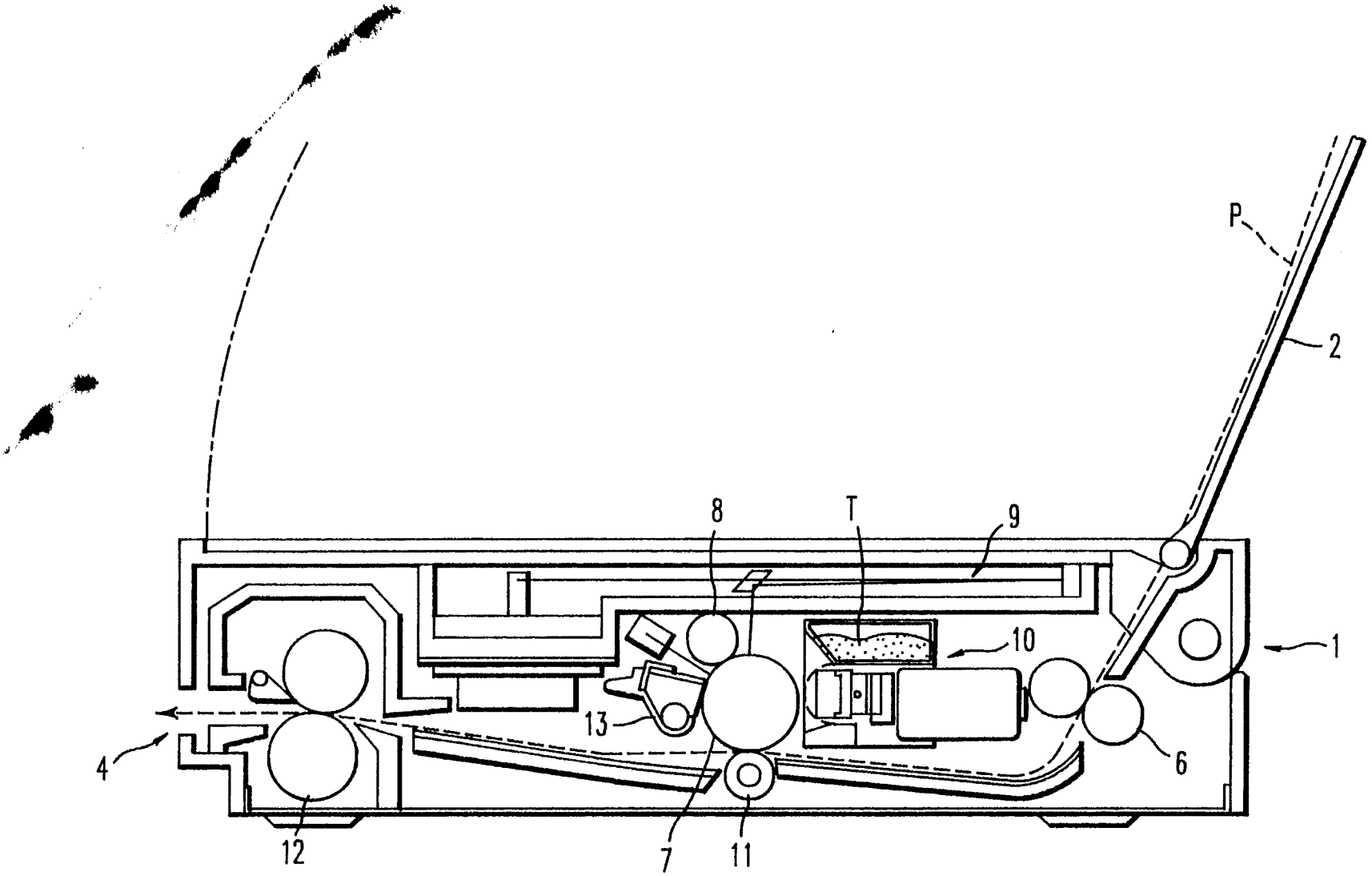
FIG. 2 is a transverse cross-sectional view of the printer.

Referring now to the drawings, wherein like reference numerals designate identical or corresponding parts throughout the several views, illustrative examples of the present invention will now be described. As shown in FIGS. 1(*a*) and 1(*b*) the present invention is particularly advantageous in the context of a small compact printer. As shown in FIGS. 1 and 2, printing paper P is inserted by an operator into a predetermined position on a paper guide 21, with the paper then fed through a roller 6 and into the machine at a predetermined timed relation, with the paper receiving a toner image formed on a photosensitive drum at a transfer position. The photosensitive drum is charged by a charging device 8, to a charge of, for example, −700V, and thereafter exposed by an exposing device 9 which can be, for example, a laser beam which produces an electrostatic latent image having an electrical potential of −100V. The latent image is then visualized or developed by a one-component magnetic toner having a negative electrical charge, with the toner accommodated in the developing device 10. During development of the latent image, a developing bias having an electrical potential of −500V is applied to the developing device to prevent the toner from adhering to blank parts of the printing paper P. The visualized toner image is then transferred to the paper P, with the assistance of a transferring device 11, and the image is fixed by a fixing device 12 composed of a pair of heating rollers, as the printing heat passes therethrough. The paper having an image fixed thereon is then ejected from the machine through an outlet 4. Remaining toner on the photosensitive drum 7 (after the transfer of the developed image to the printing paper P) is wiped by a cleaning device 13 so that the drum can be repeatedly utilized.

Figure 3:
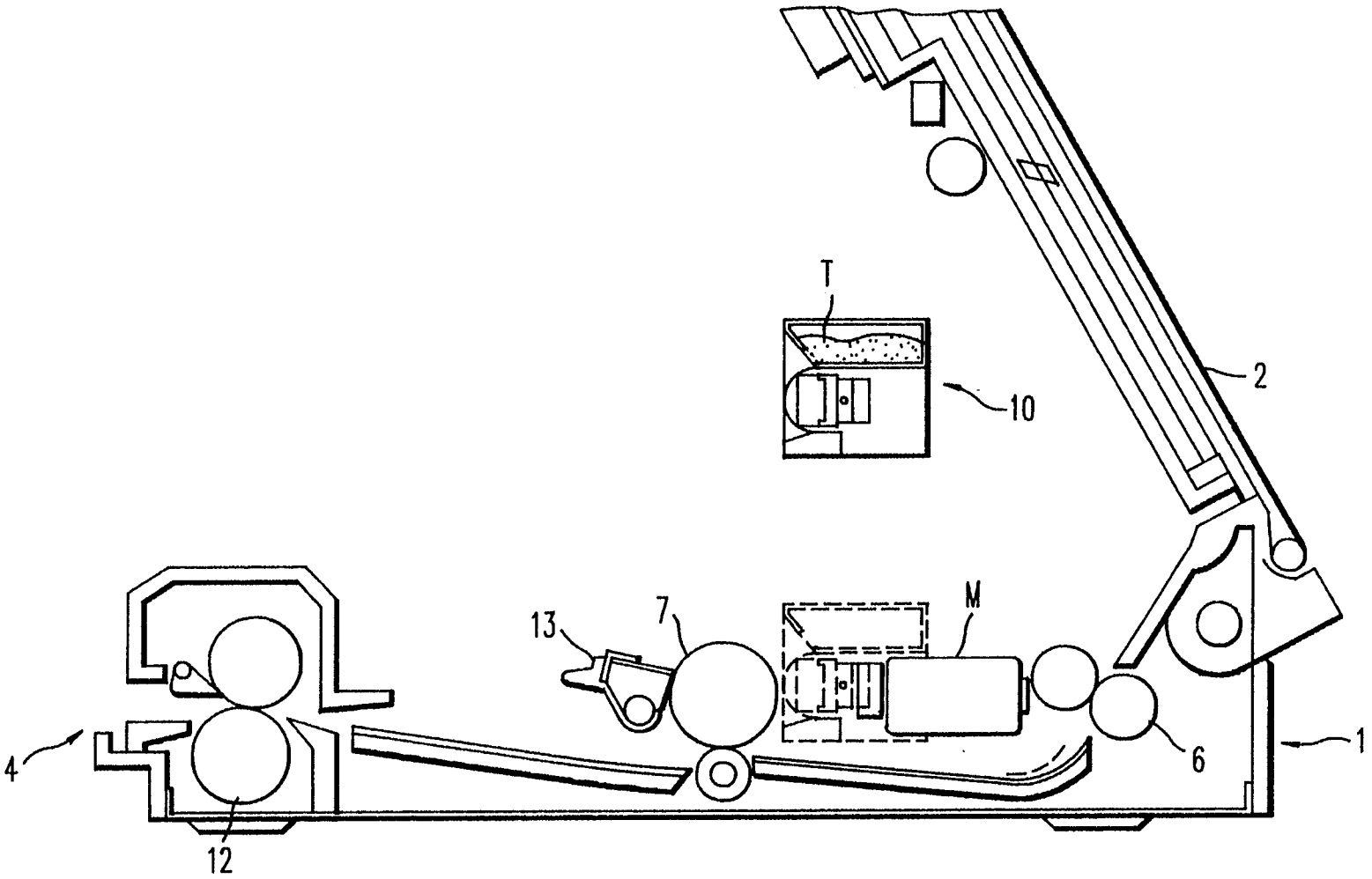
FIG. 3 is a transverse cross-sectional view of the printer of FIG. 2, with the upper unit open, and with the developing unit shown detached.
Figure 4:
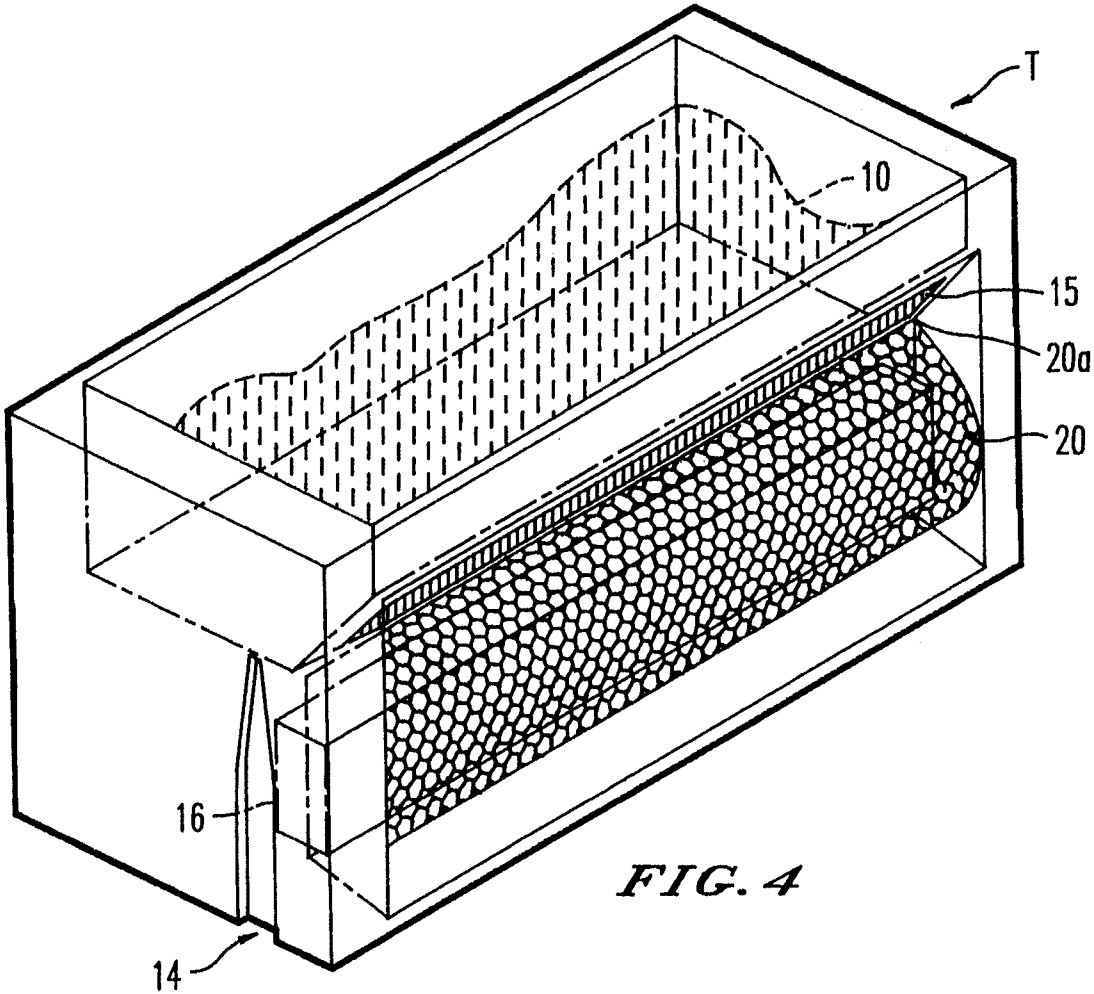
FIG. 4 is a perspective view of the developing unit of the present invention.

Referring now to FIG. 3, the developing device 10 can be detached from the printer 1 by withdrawing it in an upward direction and by releasing a connection of the developing device with a driving motor M. The motor M causes vibration of the magnetic brush, which will be explained in further detail hereinafter. Referring to FIG. 4, a guiding part 14, such as a pair of grooves (one of which is provided on the side not shown in the figure) are disposed on the sides of the developing device 10. The grooves thus provide for guiding of the developing device in cooperation with a protruding part disposed in the printer body 1 (not shown in the figures) during detachment and replacement of the developing device. An opening 15 (see also FIG. 5) is utilized as an outlet for toner which is disposed in the developing device 10, such that toner accommodated in the developing device can pass to the outside (of the developing device) under gravity. A magnet bar 16 is provided for catching the toner T by its magnetic force, and with the magnet bar and toner forming a magnetic brush extending outside of the-developing device. The magnet bar 16 is disposed below the opening 15.

In addition, a developing grid 20 is disposed such that it covers the magnet bar 16, at least along an outside or exposed part of the developing device 10, with an upper part of the grid connected to a portion of the developing device disposed below the opening 15. The developing grid 20 cooperates with the magnet, and also functions to stop toner from freely falling from the developing device, as will be explained in further detail hereinafter. The developing grid 20 includes a plurality of hexagonally shaped holes formed therein, with a developing bias applied to the grid during the developing process. As a material for the developing grid, a dielectric material can be utilized, either of a magnetic or non-magnetic type. Where a magnetic material is utilized for the developing grid, a thickness of less than 0.5 mm should be utilized, preferably 0.2 mm to avoid a strong magnetic shielding effect. The diameter of each of the holes of the developing grid 20 should be less than 3 mm, and preferably 2 mm or less. In addition, the open area or the area having holes therein of the grid 20 should be at least 30%, and preferably 60% of the entire area to provide a high-quality copy or print. Instead of hexagon-shaped openings for the developing grid 20, other shapes can also be utilized. Preferably, a permanent type magnet is utilized for the magnet 16.

Figure 5:
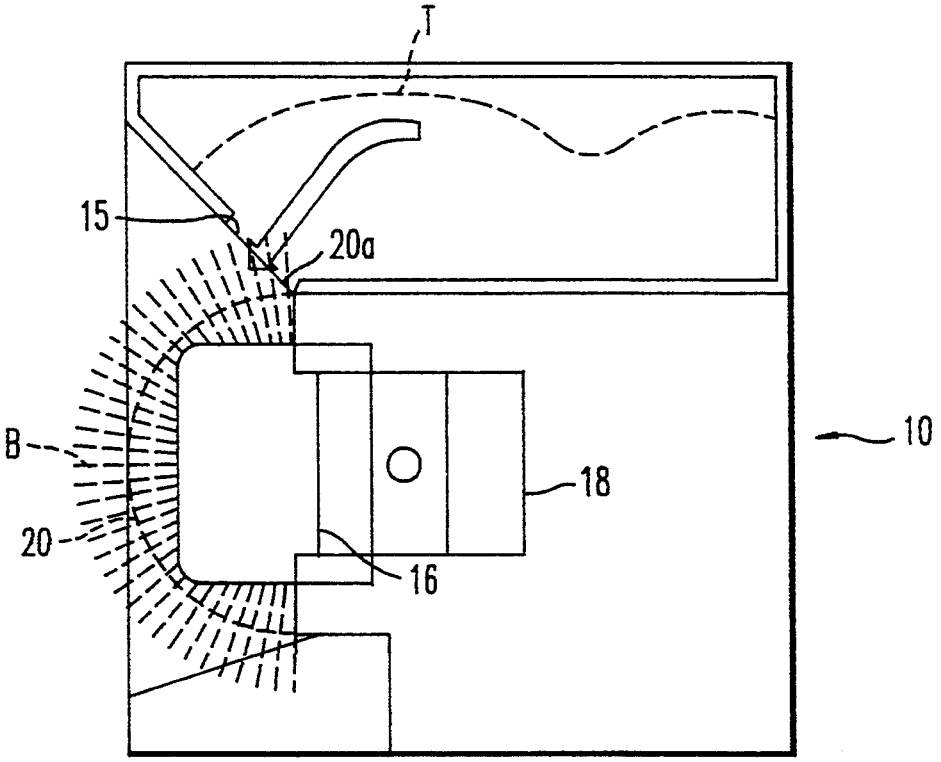
FIG. 5 is a cross-sectional view of the developing unit showing the flow of a toner developer.

As shown in FIG. 5, a magnetic brush B is formed by the magnetic force or field of the magnet bar 16 extending through the holes of the developing grid 20, such that part of the magnetic brush B also blocks the opening 15. With this arrangement, falling of toner through the opening 15 disposed at a lower part of the developing device (and lower part of the toner container of the developing device) is avoided, since the brush B (FIG. 5) cannot move in the direction perpendicular to that of the magnetic field due to the resistance from the holes formed in the developing grid 20. Thus, a blocking force is provided by the magnetic brush B against the continuance of falling toner, and the blocking force can be strong enough to avoid excessive falling toner, even when a strong force is incurred from the outside of the machine, since the pressure of the toner T passing through the opening 15 is received or accommodated by both the magnetic brush B and the developing grid 20 covering the magnet 16. Thus, the pressure of the toner attempting to fall through the opening 15 is suppressed, and the falling toner pressure is divided in two. In particular, the stickiness or effectiveness of the magnetic brush B as discussed above is larger than that of the conventional flexible magnetic brush which does not include such a grid arrangement, due to the strongest parts of the magnet being provided on the inside of the developing grid 20.

Upon execution of a developing operation with the present invention, the toner forming the magnetic brush B is consumed, and as a result, the magnetic brush B becomes weak and thus does not block the toner from falling or passing through the opening of the developing device 10. Thus, after a developing operation, toner is allowed to pass through the opening, and the magnetic brush B is rebuilt, and is ready for subsequent developing operations, while again exerting the strong blocking function. Accordingly, as should be readily apparent from the foregoing, the present invention not only provides for a reliable feed of toner for developing, but also prevents excessive falling or scattering of toner from the developing device.

Figure 6:
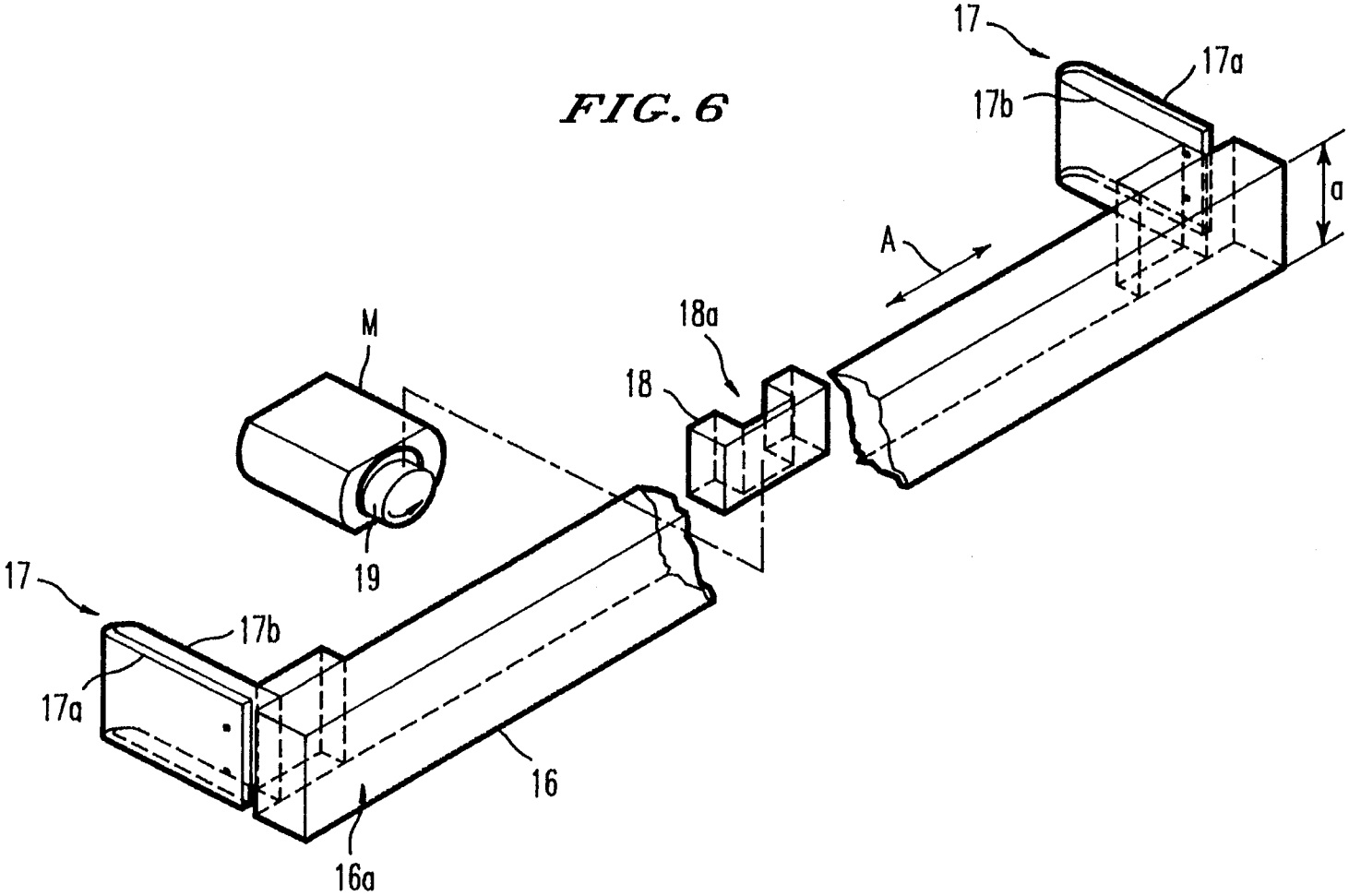
FIG. 6 is a perspective view of a vibrating apparatus utilized in accordance with the present invention.

A further advantageous aspect of the developing device of the present invention will now be discussed with reference to FIG. 6. As shown in FIG. 6, the magnet bar 16 is connected to the body of the developing device via a pair of swing levers 17. Each of the swing levers 17 includes a thin part **17*b* and a thick part 17*a*, which together form a U-shaped plate. Each of the thin parts 17*b* is connected to a respective edge or end of the magnet 16 using a fixing tool (not shown in the figures), with each of the thick parts 17*a* fixedly connected to the body of the developing device 10. The thin parts 17*b* can thus be moved in a direction perpendicular to the plate surface thereof. A coupling block or holder 18 having a channel or grooved portion 18*a* (which faces toward the inside of the developing device 10) is fixed to the back side of the magnet bar 16. In addition, an eccentric cam 19 is connected to a shaft of the motor M and the periphery of the cam fits into the channel portion 18*a* of the holder 18**.

With the developing device 10 inserted in the printer body 1 (along the guiding grooves 14 discussed earlier), the swing lever 17, the connector block 18, the motor M and the eccentric cam 19 cooperate to vibrate the magnet 16 while the motor M is driven. As the motor M starts rotating, the periphery of the channel portion **18*a* contacts or is moved by the periphery of the rotating eccentric cam and thus the magnet bar 16 vibrates both forward and backward in a direction parallel to the axis of the drum 17, as represented by arrow A in FIG. 6. In this condition, due to the vibration of the magnet bar 16 during developing of the latent image formed on the photosensitive drum 7, the magnetic brush B is partly cut off by the grid 20 intermittently. As a result, the magnetic brush which is partly cut off by the grid 20 falls down and is held by the grid 20, or is held in a floating state there around, and this process is repeated throughout developing operations. A fine gradient image is thus obtained as a result of the soft contact of the toner T, as the brush is partly cut off, and the toner is transferred to develop a latent image. Thus, as should be readily apparent, deterioration of the toner is avoided, since the toner is not subjected to rough mechanical operations associated with conveying and applying toner to a photosensitive drum in conventional devices. Further, by virtue of the cooperation of the magnet and the grid, the magnetic brush B serves to regulate the fall of toner through the opening 15**. Thus, by utilizing the magnet and grid structure to form a magnetic brush, the brush B self-regulates the flow of toner such that scattering of excessive toner is avoided or at least reduced.

According to tests performed by the inventor of the present invention, a grid having the following characteristics has been recognized as highly suitable in obtaining a fine gradient image. In particular, the material for the grid can be advantageously selected as an electrically casted nickel, with the thickness thereof 0.1 mm, and the ratio or the proportion of the open area of the grid as 90%, and with the diameter of a representative hole 2 mm. The width of the vibration of the magnet bar 16 has been found suitable at 2 mm, with a frequency of the vibration of 45 Hz. In addition, a pair of dry cell 1.5V batteries can be utilized as an electrical source for the motor M, however other power sources may also be utilized. Even though the above discussed vibration is applied to the magnet bar 16, excessive toner is nevertheless prevented from falling from the developing device due to the cooperation and control of the flow pressure of the toner T by both the magnetic brush B and the developing grid 20. Of course, the present invention should not be construed as limited to the foregoing embodiment, particularly as to specific sizes and materials, as other arrangements and modifications are possible.

As a modification or alternative to the arrangement discussed above for the magnetic grid 20, the upper part 20*a* of the grid 20 can also be connected to the developing device at a location above the opening 15. With this arrangement, the pressure of the toner falling from the opening 15 is also shared by both the grid 20 and the brush B, and thus, the wasteful and inconvenient excessive fall of toner T is controlled. Even where the grid 20 covers the opening 15 (i.e., in contrast to the FIG. 5 arrangement if the grid 20 extends to the top of the opening 15), the magnet/brush and grid nevertheless cooperate to regulate falling toner as will now be described. First, the toner T passes through the opening 15 and is caught immediately thereafter by the magnet bar 16, thereby forming the magnetic brush B. After forming the brush B, subsequent toner T passing through the opening 15 is temporarily blocked by the part of the magnetic brush B built around the magnet bar 16 in the position adjacent to the opening 15. As part of the toner overcomes the blocking of the magnetic brush B, and falls by gravity, it is received by the developing grid 20, which also inhibits free falling of toner. At this stage, if the magnet bar 16 begins vibrating, the magnetic brush grows through the developing grid 20, such that the developing device is ready to execute a developing operation. Accordingly, even where the developing grid is disposed to cover both the opening 15 and the magnet 16, excessive feed of toner is avoided, since both the developing grid 20 and magnetic brush B share the pressure of toner falling through the opening 15.

Figure 7:
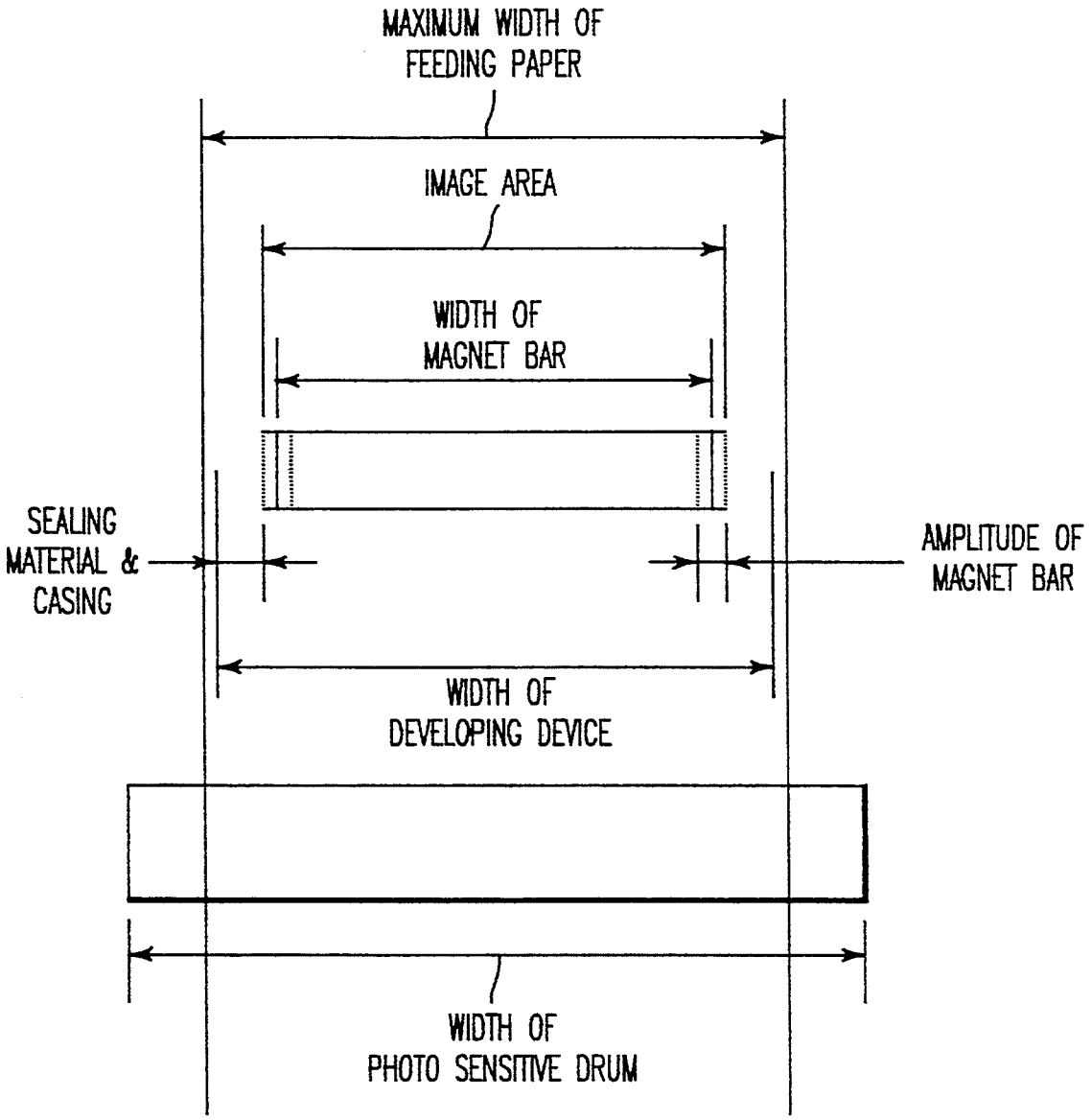
FIG. 7 is a schematic illustration showing the relationship between the widths of various portions of the image forming apparatus and developing device, particularly the relationship between the image area and the magnet.

The developing device 10 of the present invention can also be advantageously minimized in size, particularly with regard to the width, as will now be explained. FIG. 7 illustrates the relationship between the width of the image formed on the photosensitive drum and the length of the magnet bar 16. As shown, the width of the magnet bar 16 is smaller than the maximum width of the toner image to be transferred to the printing sheet P, and the width of the latent image forming area on the photosensitive drum 7 is larger than that of the magnet bar 16. In addition, the magnet bar 16 is vibrated in the direction parallel to the axis of the photosensitive drum 7 as explained above, such that the magnetic brush B can cover the entire width of the latent image forming area of the photosensitive drum 7. In this embodiment, as should be readily apparent from FIGS. 6 and 7, the width of the vibration can be determined by the design of the eccentric cam 19, for example by the difference in the diameter of the eccentric cam 19. It has been recognized that the width of the vibration of the magnet 16 should practically be less than 5 mm, preferably less than 3 mm. With the width of the vibration of the magnet 16 provided as 2 mm, and a maximum printing sheet size corresponding to A4 paper (210 mm×297 mm), the photosensitive drum 7 should be selected to have a width of more than 210 mm. If a margin formed on both edges of the printing sheet is 5 mm, the width of the image forming area is thus 200 mm, and the width of the magnet 16 can thus be selected as 198 mm (which covers the image area with the 2 mm vibration). Thus, the magnetic brush B can cover all of the latent image formed on the photosensitive drum 7, with the magnet vibrating along the width of the image area. The developing device accommodates the vibrating magnet bar 16 and a toner container within an outer casing, and thus is slightly greater in width than 200 mm (198 mm width of the bar 16 plus the amplitude of vibration thereof). The casing of the developing device 10 is usually formed of plastic with a thickness of approximately 1 mm. In addition, a sealing member is provided for avoiding toner leakage from the developing device 10 to the outside thereof, with the sealing member inserted between the outer casing and the magnet bar 16.

As should be readily apparent from the above, with the structure of the present invention, the developing device can be provided with a compact design, for example, which is only greater in width (a few mm) than the image forming area. Thus, with the arrangement of the present invention, it is possible to make the developing device 10 of approximately the same width as the maximum printing sheet width to which an image is applied. Accordingly, it is not necessary for the developing device to have a width greater than that of the photosensitive drum, and the developing device may even be smaller than the width of the photosensitive drum.

The principal and operation of the developing device with the vibrating magnet bar 16 will now be explained based upon an actual test example. With a moving speed of the latent image formed on the photosensitive drum 7 (i.e., the rotational speed of the photosensitive drum 7) provided as 50 mm per second, and a frequency of the magnet 16 of 50 Hz, the locus or path of a point on the periphery of the magnet bar 16 draws a sine curve or travels along a sine curve path having an amplitude of 2 mm, and a pitch of 1 mm relative to the photosensitive drum 7. With such an arrangement, the following results were realized. Where the thickness of the magnet bar 16 in the direction of rotation of the drum 7 is too small, the above sine curve is found on both sides of the toner image. By contrast, in the case where the thickness of the magnet bar 16 is sufficient as shown in FIG. 6, such a sine curve pattern is not found. This results with the above mentioned pitch of 1 mm, since the pitch of 1 mm can be covered by the action of the vibrating magnet bar 16 under the normal speed of rotation of the photosensitive drum 7 (i.e., the magnet is sufficiently thick to cover the image area for the above pitch and speed of the photosensitive drum).

Where the magnetic brush B is formed to be inclining toward the outside of the magnet bar 16, with the brush B partially protruding from the edges of the bar, the magnetic brush B can extend not only to the latent image within the width of the magnet bar, but also outside thereof. Thus, a magnet even shorter than that described above is also possible. In addition, although the foregoing has been described with reference to a one component magnetic toner, a type of one component magnetic toner which includes a toner and magnetic carrier beads can also be utilized. With this type of toner there is also no problem with deterioration of the toner, or changes in the mixture ratio between the toner and carrier.

As should be readily apparent, the present invention reduces leakage of toner T from the developing device, which leakage can be caused by excessive toner falling from the opening of the toner container. Thus, with the cooperation of the magnet and the grid of the present invention, even though the magnetic brush is subjected to vibrations the brush assists in regulating the flow of toner. Further, a high gradient or high resolution toner image copy or print is obtained as a result of the soft contact of the magnetic brush with the latent image formed on the photosensitive drum. In addition, scattering of toner is effectively diminished, particularly in the case of the one-component magnetic toner as compared with the two-component magnetic toner. Moreover, a compact driving device can be employed due to the small load required for driving, thus also providing a contribution to the compact size of the developing apparatus.

The present invention is also advantageous in realizing a compact design, with the device having substantially the same size as the maximum printing paper size being fed in a direction of the width of the paper. Since the width of the magnet bar 16 is shorter than that of the latent image area on the photosensitive drum 7, the amplitude of the magnet 16 is designed or selected to have a length corresponding to the difference between the width of the magnet bar 16 and that of the latent image area. Further, the mechanism for vibrating the magnet is advantageously disposed at the back of the magnet rather than a side thereof.

Thus, the width of the developing device can be substantially the same as the size of the latent image area of the photosensitive drum, or substantially the same as the width corresponding to the maximum size printing sheet to be accommodated by the image forming apparatus. Accordingly, the developing device need only exceed the width of the magnet plus the vibrational movement of the magnet, and the thickness of the outer casing of the developing device. Such an arrangement is significantly more compact as compared with conventional arrangements, for example as disclosed in Japanese Published Patent Application No. 37-12640/1962, and clearly toner is not degraded as compared with conventional devices as shown, for example, in Japanese Published Application No. 39-8149/1964. Further, the present invention provides for reliable feeding of toner, and reliably supplies toner during a developing process. In addition, the toner carrying device is relatively simple (as compared, for example, to Japanese Published Application No. 53-16441/1978), since the magnet brush can be formed directly on the magnet bar 16 without utilizing a developing sleeve.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A developing device for developing a latent image formed on a photosensitive member with a magnetic toner brush formed by a magnet bar comprising:

a developing toner container accommodating toner therein and having an opening at a lower part thereof, through which the toner accommodated in said developing toner container falls by gravity; and a toner receiving means for receiving said toner falling through the opening of the toner container, said toner receiving means having holes therein and disposed adjacent to said opening of said toner container;

whereby, a pressure of the toner falling by gravity through the opening is shared by both of said magnetic toner brush and said toner receiving means.

2. A developing device for developing a latent image as claimed in claim 1, wherein a one-component magnetic toner is disposed in the toner container thereby providing the developing toner.

3. A developing device for developing a latent image formed on a photosensitive drum with a magnetic toner brush formed by a magnet bar comprising:

a covering means for covering the magnet bar, which forms the magnet brush therearound, said covering means having holes therein through which the magnetic toner brush is built; and moving means for relatively moving the magnetic toner brush and the covering means during the developing process, whereby, the magnet toner brush is cut off by the covering means.

4. A developing device for developing a latent image as claimed in claim 3, wherein the magnetic toner brush is formed directly around the magnet bar.

5. A developing device for developing a latent image as claimed in claim 3, wherein a bias voltage is further applied to the covering means during the developing process.

6. A developing device for developing a latent image formed on a photosensitive drum with a magnetic toner brush formed by a magnet bar comprising:

magnet bar supporting means for elastically supporting the magnet bar at first and second edges thereof;

vibrating means for vibrating the magnet bar supporting means in the direction parallel with the axis of the drum during a developing process, said vibrating means disposed adjacent a side of the magnet bar which is opposite a side which faces photosensitive drum.

7. A developing device for developing a latent image as claimed in claim 6, wherein the magnetic toner brush is formed such that at least a portion of the magnetic toner brush is inclined relative to the magnet bar to protrude therefrom.

8. A developing device for developing a latent image as claimed in claim 6, wherein the magnet bar is a permanent-type magnet.

9. A developing device as claimed in claim 6, wherein the amplitude of the vibration of the vibrating means substantially corresponds to a difference of width between a latent image forming area on said photosensitive drum and said magnet bar.

10. A developing device comprising:

a toner container having an opening at a lower portion thereof through which toner exits said toner container;

a magnet bar disposed below said opening;

a grid at least partially covering said magnet bar, said grid having a plurality of openings therein; and a vibrating mechanism connected to said magnet bar.

* * * * *